US008215887B2

(12) United States Patent
Fikowski et al.

(10) Patent No.: US 8,215,887 B2
(45) Date of Patent: Jul. 10, 2012

(54) PIPE-HANDLING APPARATUS AND METHODS

(75) Inventors: Larry M. Fikowski, Calgary (CA); Glenda Fikowski, legal representative, Calgary (CA); Douglas A. Hunter, Calgary (CA); Friedhold Brost, Sidney (CA)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 12/916,946

(22) Filed: Nov. 1, 2010

(65) Prior Publication Data

US 2011/0044787 A1 Feb. 24, 2011

Related U.S. Application Data

(62) Division of application No. 10/908,951, filed on Jun. 1, 2005, now Pat. No. 7,832,974.

(51) Int. Cl.
*E21B 19/00* (2006.01)
*E21B 19/14* (2006.01)
*E21B 19/15* (2006.01)

(52) U.S. Cl. ..... 414/22.58; 414/22.54

(58) Field of Classification Search ..... 193/15; 211/70.4; 414/17, 22.51–22.59, 22.61–22.62, 414/339, 349, 395, 398, 400–401, 430, 480, 414/537, 680, 745.8, 745.9, 746.1, 746.2, 414/746.4, 746.8; 89/1.8, 1.801
See application file for complete search history.

(56) References Cited

U.S. PATENT DOCUMENTS

| | | | | |
|---|---|---|---|---|
| 2,643,006 | A | | 6/1953 | King |
| 3,128,893 | A | * | 4/1964 | Jones ..... 414/462 |
| 3,159,286 | A | | 12/1964 | Freeman, Sr. |
| 3,169,645 | A | | 2/1965 | Freeman, Sr. |
| 3,217,900 | A | | 11/1965 | Kupetzky et al. |
| 3,307,719 | A | | 3/1967 | Martin, Jr. |
| 3,494,483 | A | | 2/1970 | Smart |
| 3,651,959 | A | | 3/1972 | Castela et al. |
| 3,706,347 | A | | 12/1972 | Brown |

(Continued)

FOREIGN PATENT DOCUMENTS

CA 1139299 1/1983

(Continued)

OTHER PUBLICATIONS

International Search Report WO 06/128300 (PCT/CA06/000904).

(Continued)

*Primary Examiner* — Gregory Adams
(74) *Attorney, Agent, or Firm* — Haynes and Boone, LLP

(57) ABSTRACT

A pipe-handling apparatus adapted to move pipe to and from a drilling floor of a drilling rig including a ramp extendable between a main support structure and the drilling floor, a pipe carrier mounted on the main support structure configured to move between lower and elevated positions over the ramp, a lift arm including a first end and a second end and being pivotally connected at its first end adjacent the far end of the carrier and operable below the carrier to lift and support the carrier's far end to an elevated position, a track on the main support structure for supporting the carrier and the lift arm, and a drive system that pivots or moves the lift arm up about a track stop to lift the far end of the carrier and moves the near end up and over the ramp.

29 Claims, 12 Drawing Sheets

U.S. PATENT DOCUMENTS

| | | | | |
|---|---|---|---|---|
| 3,710,961 | A * | 1/1973 | Bomstein | 414/396 |
| 3,736,881 | A * | 6/1973 | Lorinet | 104/293 |
| 3,780,883 | A | 12/1973 | Brown | |
| 3,785,506 | A | 1/1974 | Crocker et al. | |
| 3,810,553 | A | 5/1974 | Crocker et al. | |
| 3,883,009 | A | 5/1975 | Swoboda, Jr. et al. | |
| 3,883,820 | A | 5/1975 | Burns et al. | |
| 4,051,775 | A | 10/1977 | Watson | |
| 4,051,956 | A | 10/1977 | Teague | |
| 4,067,453 | A | 1/1978 | Moller | |
| 4,129,221 | A | 12/1978 | Moller | |
| 4,143,534 | A | 3/1979 | Hartkopf et al. | |
| 4,147,266 | A | 4/1979 | Corompt | |
| 4,235,566 | A | 11/1980 | Beeman et al. | |
| 4,347,028 | A | 8/1982 | Dugan | |
| 4,361,223 | A | 11/1982 | Johnson | |
| 4,379,676 | A | 4/1983 | Frias | |
| 4,380,297 | A | 4/1983 | Frias | |
| 4,382,738 | A | 5/1983 | Frias | |
| 4,386,883 | A | 6/1983 | Hogan et al. | |
| 4,403,898 | A | 9/1983 | Thompson | |
| 4,426,182 | A | 1/1984 | Frias et al. | |
| 4,470,740 | A | 9/1984 | Frias | |
| 4,474,520 | A | 10/1984 | Buckner et al. | |
| 4,494,899 | A | 1/1985 | Hoang et al. | |
| 4,533,055 | A | 8/1985 | Haney | |
| 4,696,207 | A | 9/1987 | Boyadjieff | |
| 4,709,766 | A | 12/1987 | Boyadjieff | |
| 4,765,401 | A | 8/1988 | Boyadjieff | |
| 5,077,852 | A | 1/1992 | Karlsson | |
| 5,137,114 | A | 8/1992 | Yde et al. | |
| 6,079,925 | A | 6/2000 | Morgan et al. | |
| 6,533,519 | B1 | 3/2003 | Tolmon et al. | |
| 6,695,559 | B1 * | 2/2004 | Pietras | 414/22.57 |
| 7,163,367 | B2 | 1/2007 | Handley | |
| 7,300,239 | B2 | 11/2007 | Benedikt | |
| 7,469,749 | B2 | 12/2008 | Folk | |
| 7,473,065 | B2 | 1/2009 | Wells | |
| 7,832,974 | B2 * | 11/2010 | Fikowski et al. | 414/22.54 |
| 2004/0136813 | A1 | 7/2004 | Pietras | |
| 2004/0197166 | A1 | 10/2004 | Tolman et al. | |
| 2005/0079044 | A1 | 4/2005 | Handley | |
| 2005/0238463 | A1 * | 10/2005 | Smith | 414/22.52 |
| 2006/0045655 | A1 | 3/2006 | Wells | |
| 2006/0104746 | A1 * | 5/2006 | Thompson | 414/22.54 |
| 2006/0124356 | A1 | 6/2006 | Gust et al. | |
| 2006/0285941 | A1 * | 12/2006 | Fikowski et al. | 414/22.54 |
| 2007/0114113 | A1 | 5/2007 | Muse et al. | |
| 2007/0177967 | A1 | 8/2007 | Lesko | |
| 2007/0193749 | A1 | 8/2007 | Folk | |
| 2007/0221385 | A1 | 9/2007 | Braun et al. | |
| 2007/0286708 | A1 | 12/2007 | Smith et al. | |
| 2009/0196711 | A1 | 8/2009 | Gerber et al. | |
| 2009/0252576 | A1 | 10/2009 | Gerber et al. | |
| 2011/0044787 | A1 * | 2/2011 | Fikowski et al. | 414/22.59 |

FOREIGN PATENT DOCUMENTS

| | | |
|---|---|---|
| CA | 1161427 | 1/1984 |
| CA | 1185228 | 4/1985 |
| CA | 1195241 | 10/1985 |
| CA | 1254194 | 5/1989 |
| CA | 2115810 | 10/1998 |
| CA | 2224638 | 6/1999 |
| CA | 2496440 | 11/2003 |
| CA | 2508998 | 12/2006 |
| CA | 2551884 | 1/2007 |
| EP | 1888872 | 2/2008 |
| UA | 371 | 8/1999 |
| UA | 74759 | 1/2006 |
| WO | WO 2006/128300 | 12/2006 |

OTHER PUBLICATIONS

PCT Written Opinion of the International Searching Authority WO 06/128300 (PCT/CA06/000904).

PCT International Preliminary Report on Patentability WO 06/128300 (PCT/CA06/000904).

Operating Manual for the Pipe Handler—machine set-up, 41 pages.

http://www.columbiacorp.com/#/products/pipe-handlers/4-arm-pipe-handler/, Web site Screen Shot, 1 Page.

http://www.columbiacorp.com/#/our-company/video-gallery/ , Web site Screen Shot, 1 page.

* cited by examiner

PIPE-HANDLING APPARATUS AND METHODS

CROSS REFERENCE TO RELATED APPLICATIONS

The present application is a divisional of U.S. patent application Ser. No. 10/908,951, filed Jun. 1, 2005, now U.S. Pat. No. 7,832,974, issued Nov. 16, 2010, the entire contents of which is incorporated herein in its entirety by express reference thereto.

FIELD OF THE INVENTION

The present invention relates to a pipe-handling apparatus adapted to oil well operations, and methods of using the same.

BACKGROUND

During borehole-forming and completion operations, it is necessary to make up and/or break down long strings of tubular goods such as drill pipe and casing. The string of pipe may be thousands of feet long, and it is therefore necessary to transport pipe joints (approximately 33 to 45 feet in length) from a pipe rack located away from the rig up to the rig floor. When being tripped out of the hole, the string of pipe is broken down into separate joints and returned to the pipe rack.

The handling of oil well pipe is one of the most dangerous jobs on a drilling rig. Some of the pipe joints weigh thousands of pounds, and it is difficult to move the pipe from a horizontal position below and away from the rig into a vertical position overlying hole center in the rig.

It would be desirable to have made available a pipe-handling apparatus that is useful for transporting pipe between the pipe rack and the rig floor with little danger of the pipe or the pipe racking apparatus falling and injuring property and personnel. It would, alternately or in addition, be desirable if the apparatus could position the pipe at an inclined location with an end, for example the box end, of the pipe overhanging the rig floor in ready access to the elevators. Alternately or in addition, it would also be desirable to provide a pipe-handling apparatus that reduces the requirements for manual handling. Such an apparatus is the subject of the present invention.

SUMMARY

In accordance with a broad aspect of the present invention, there is provided a pipe-handling apparatus for moving a pipe to and from a drilling floor of a drilling rig, the pipe handling apparatus comprising: a main support structure, a ramp extendable between the main support structure and the drilling floor, a carrier mounted on the main support structure for moving relative thereto between a lower position and an elevated position over the ramp, the carrier including a ramp end adjacent the ramp, an opposite end, and an elongate indentation on its upper surface to accommodate a pipe therein, a lift arm including a first end and a second end, the lift arm being pivotally connected at its first end adjacent the opposite end of the carrier and operable below the carrier to lift and support the carrier's opposite end to an elevated position, a track on the main support structure for supporting axial sliding motion of the carrier and the lift arm therealong, the track including a stop for limiting axial movement of the second end of the lift arm along the track toward the ramp, and a drive system for pulling the carrier from the lower position to ride along the ramp to an elevated position, the drive system capable of pulling the lift arm along the track until it is stopped against the stop in the track and to continue pulling to cause the lift arm to be pivoted about the stop.

It is to be understood that other aspects of the present invention will become readily apparent to those of ordinary skill in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those of ordinary skill in the art that the present invention may be practiced without these specific details.

Figure 1:
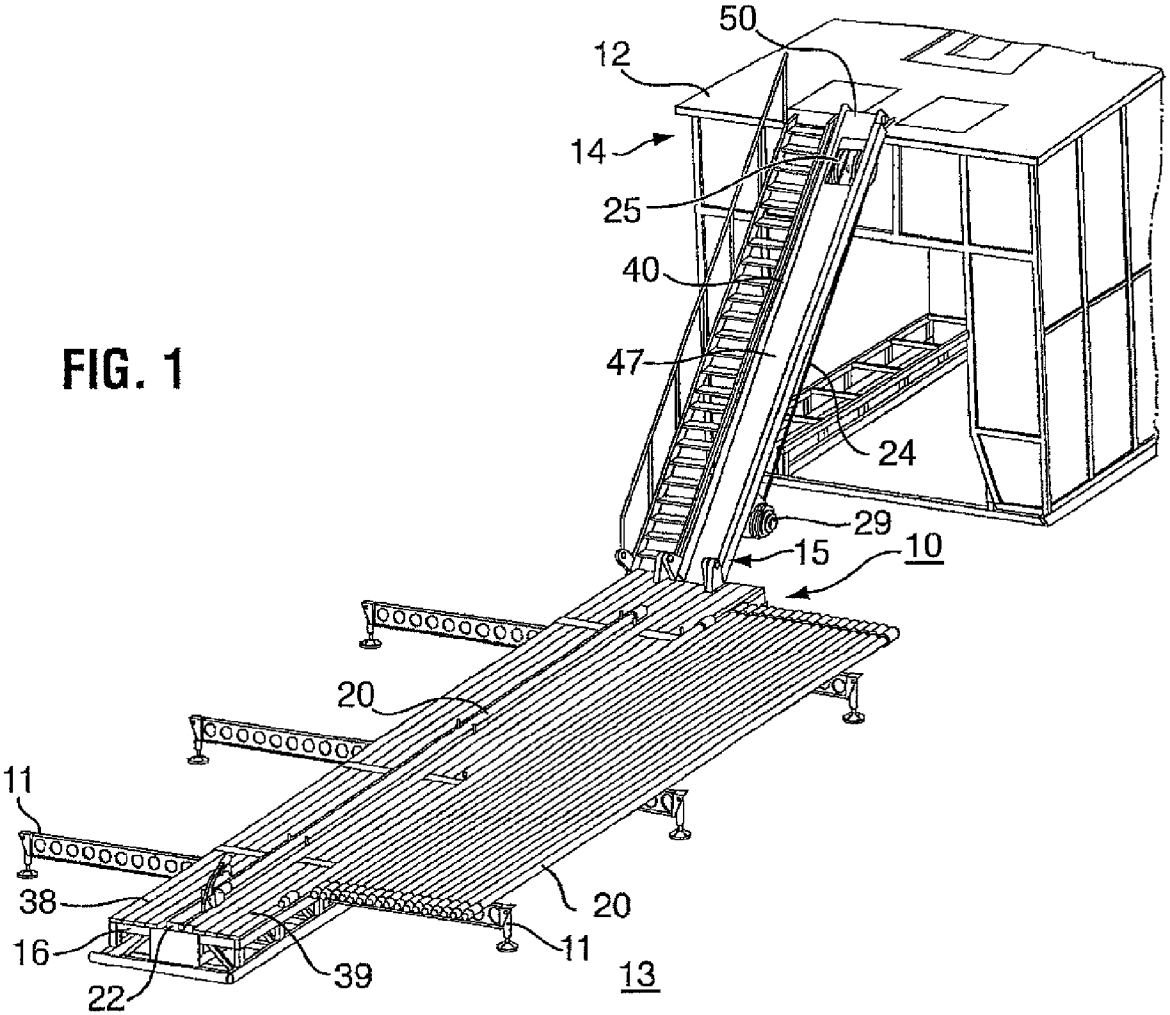
FIG. 1 is a perspective view of a pipe-handling apparatus, made in accordance with the present invention, illustrated in combination with a rig floor and a pipe rack, the apparatus being in a lower position.
Figure 2:
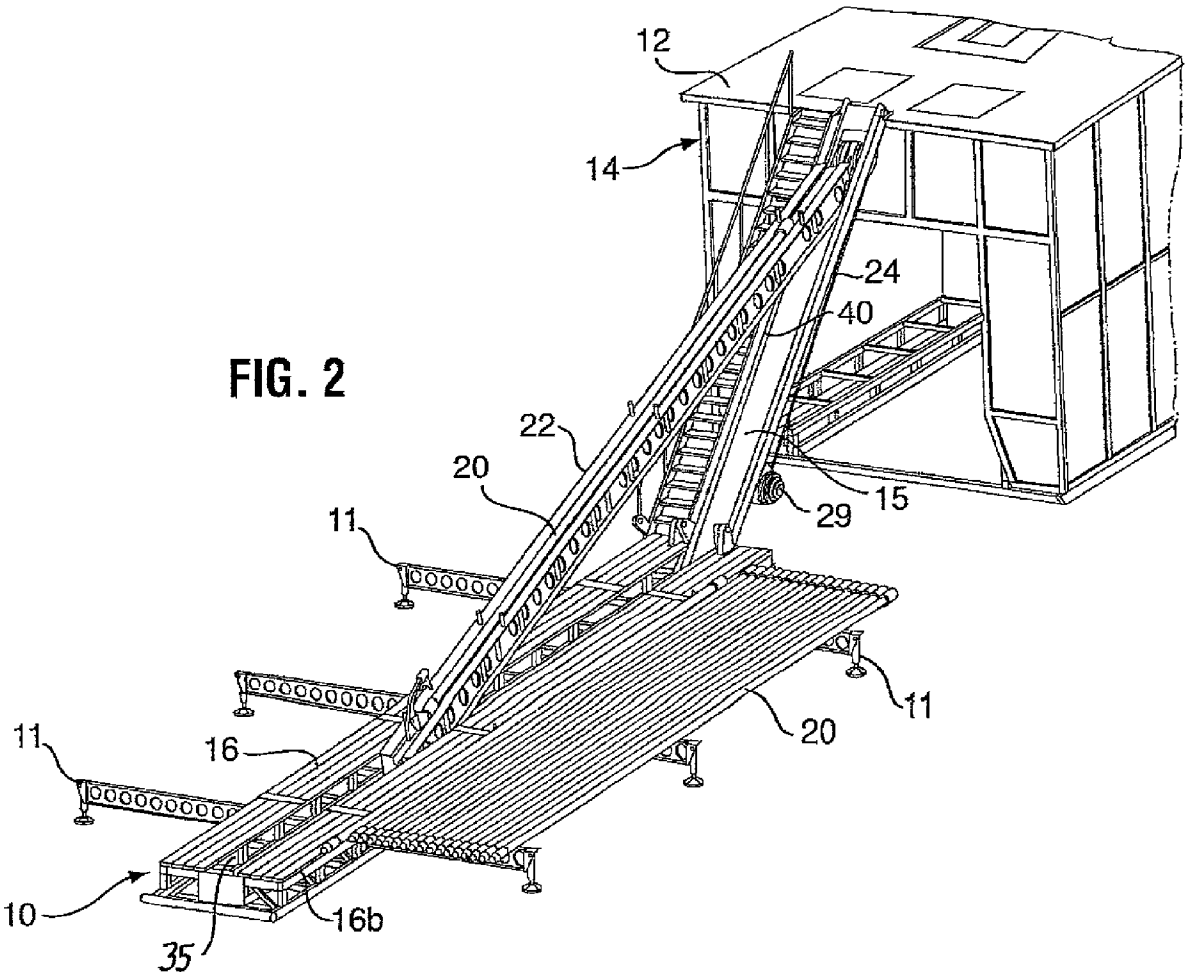
FIG. 2 is a perspective view of the pipe-handling apparatus of FIG. 1, in another stage of operation moving between a lower position and a fully elevated position.
Figure 3:
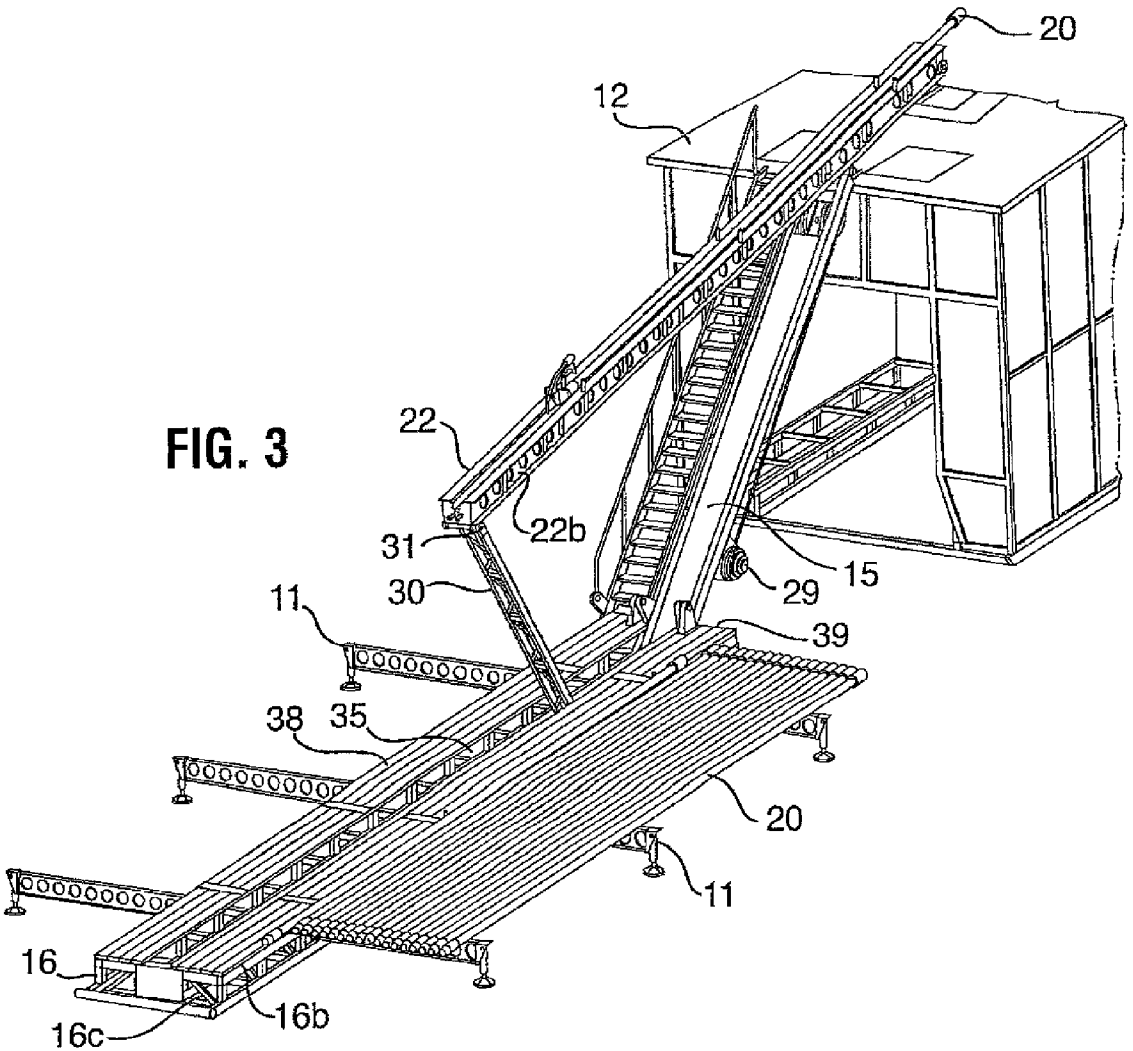
FIG. 3 is a perspective view of the pipe-handling apparatus of FIGS. 1 and 2, in another stage of operation elevated and extending over a rig floor.

In FIGS. 1 to 3 there is shown a pipe-handling apparatus 10 for conveying pipe from a ground-supported pipe rack 111 onto the floor 12 of a drilling rig 14.

Pipe-handling apparatus 10 includes, as main components, a ramp 15 and a main support structure 16 that may include one or more catwalks 38, 39 and a moveable pipe carrier 22. Main support structure 16 may be mounted on a ground surface 13 and ramp 15 interconnects main support structure 16 of the apparatus with floor 12 of the drilling rig. Pipe racks 11 can be positioned adjacent the main support structure to hold a supply, or receive, pipe joints 20. Pipe joints 20 are passed between the drilling rig and the pipe racks by pipe carrier 22, the details of which will be more fully disclosed hereinafter.

Figure 4:
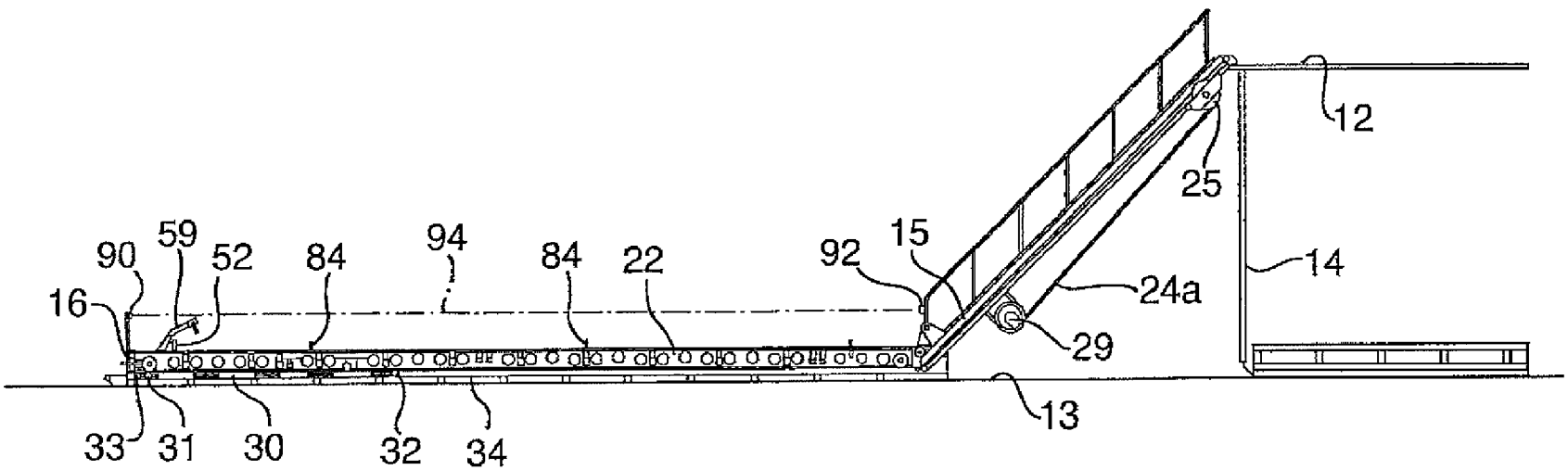
FIG. 4 is a side elevation of a pipe-handling apparatus with a catwalk cut away to show the carrier in position corresponding to that of FIG. 1.
Figure 5:
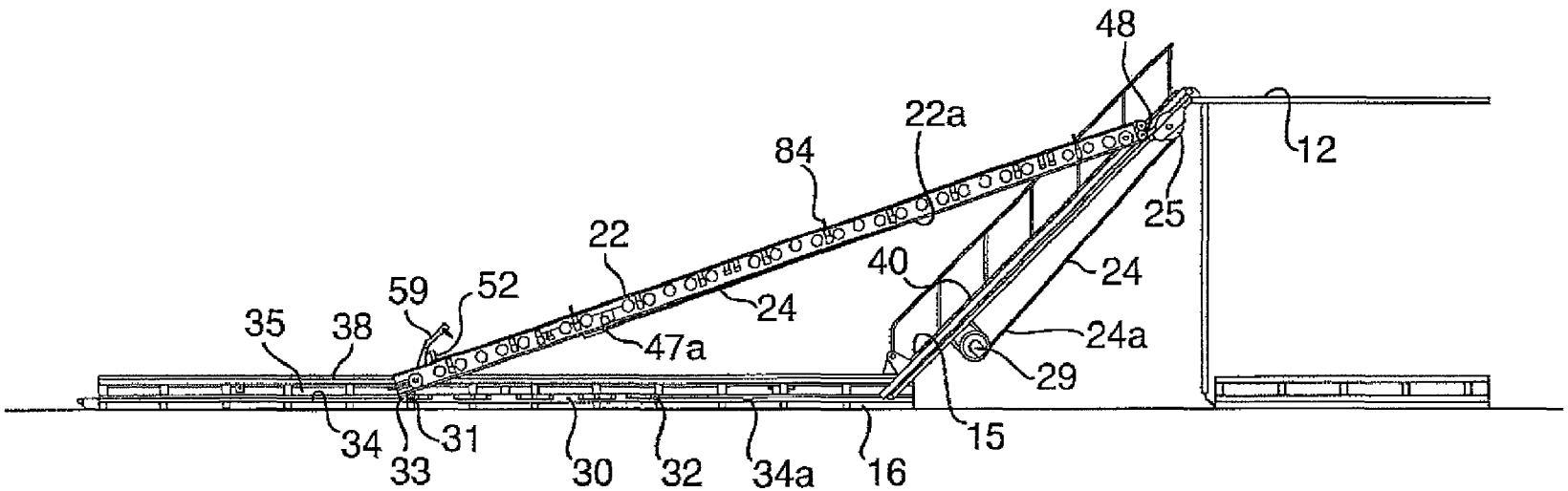
FIG. 5 is a side elevation of a pipe-handling apparatus with a catwalk cut away to show the carrier in position corresponding to that of FIG. 2.
Figure 6:
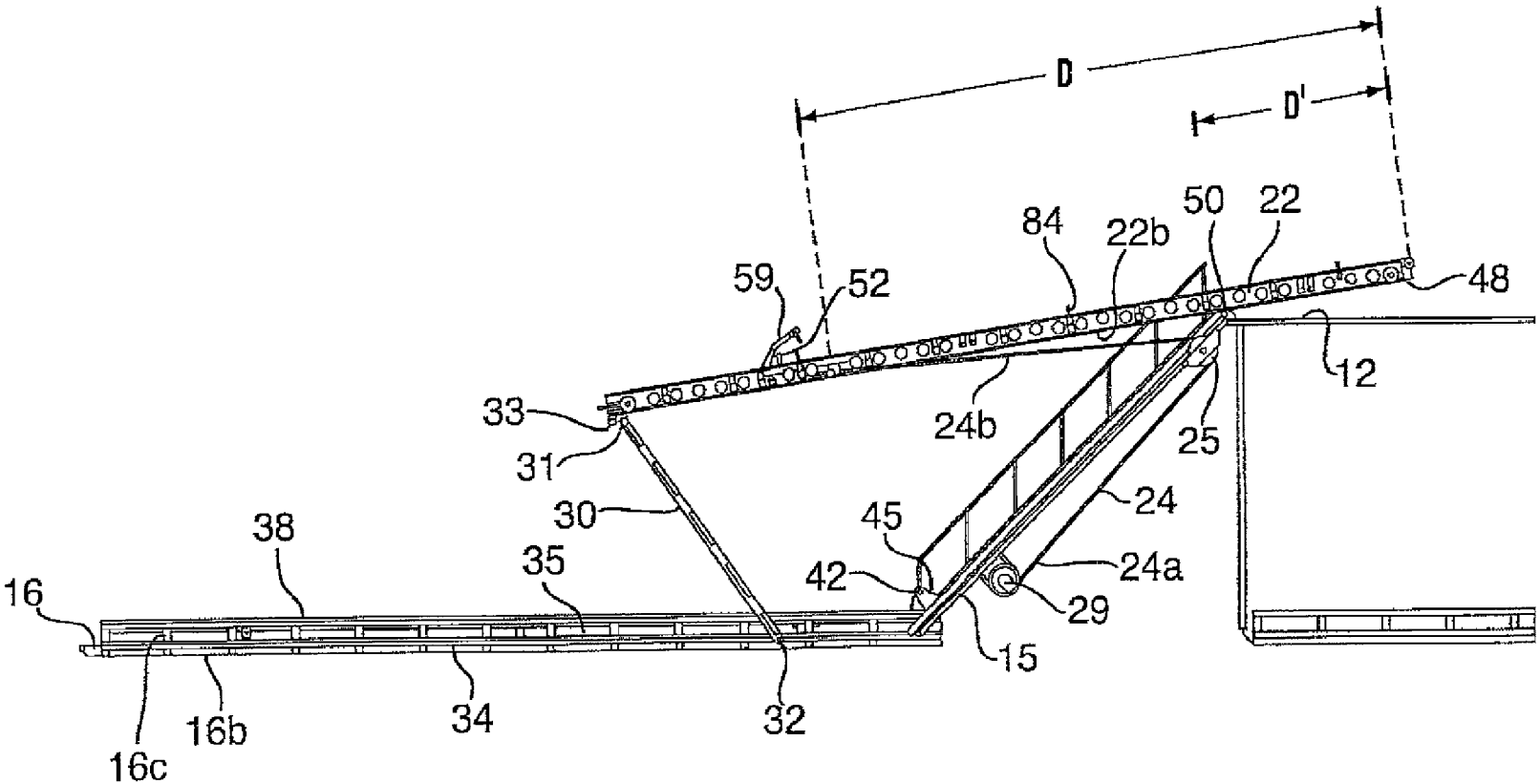
FIG. 6 is a side elevation of a pipe-handling apparatus corresponding to a position of FIG. 3.

Pipe-handling apparatus 10 includes a drive system for moving pipe carrier between a lower position (FIGS. 1 and 4), a transitional position (FIGS. 2 and 5) and an elevated position (FIGS. 3 and 6). In the following discussion, the term "ramp end" is the end of the pipe carrier adjacent the ramp, while the "far end" of the pipe carrier is the end opposite to the ramp end. In the illustrated embodiment, the drive system may be based on a cable-drive including, for example, a winch that may provide high-speed operation. In the illustrated embodiment, spaced-apart cables 24 are roved about upper sheaves 25 and each cable includes a marginal end 24*a* wound about a winch drum 29 and an opposed cable end 24*b* attached to pipe carrier 22. A plurality of cables 24 may be used for redundancy, but of course one cable could be used if desired.

The drive system further includes a carrier far end elevation assembly including a lift arm 30 journaled at 31 adjacent the far end of the pipe carrier. Carrier 22 and lift arm 30 ride along a track 34 on main structure 16 during elevation and lowering of carrier 22, for example as may be facilitated by rollers 32, 33 or friction reducing surfaces on the parts. The track extends axially along the long axis of main support structure and provides a support surface, as may be provided by a pair of elongate flanges, so that the assembly of the carrier and lift arm can move along the track toward and away from the ramp. The rollers may be flanged to facilitate centering thereof on track 34.

Lift arm 30 may take various forms. In the illustrated embodiment, the lift arm includes a pair of side beams of fixed length connected by cross members, but other forms may be useful such as one center beam, a pair of separate beams, or one or more hydraulic cylinders.

Track 34 may be positioned in a longitudinally extending, upwardly opening recess 35 for accommodating the pipe carrier 22 with its upper surface substantially flush with catwalks 38, 39.

Ramp 15 is formed to accept and support the ramp end of carrier 22 as it moves thereover through its various operational positions relative to the rig floor. In the illustrated embodiment, ramp 15 includes parallel, spaced-apart, open ended track members 40 and 41 that may be connected by a web 47 or other means to hold them in spaced apart configuration. Ramp 15 further includes an upper end 50 including a bearing surface capable of supporting movement of carrier thereover. The lower ramp end of pipe carrier 22 includes opposed rollers 48. The rollers can ride into track members 40, 41 through their open ends and are received in low-friction relationship within the opposed track members 40 and 41, when carrier 22 rides along ramp 15. An underside 22*a* of carrier is formed to ride over upper end 50, when rollers 48 exit the upper open ends of track members 40, 41, thus allowing further extension of the carrier over the drill floor. The side edges of upper end 50 can be raised relative to the bearing surface to maintain centering of the carrier on the ramp as it rides thereover.

To move the carrier between the lower position and the elevated position, winch 29 can be operated to pull on cables 24, which in turn pull on the carrier. From the position of FIG. 4, where carrier 22 is positioned in recess 35, this pulling force lifts the ramp end of the carrier out of the recess and moves rollers 48 onto ramp 15, which enter tracks 40, 41. Continued pulling force by the winch pulls carrier 22 and link arm 30 along track 34 until the end of the lift arm, for example rollers 32, are stopped, as by dropping into a pocket 34*a* in the track, as shown in FIG. 5. When this occurs with continued pulling force by winch 29, lift arm 30, through its journaled connection at 31 and from a pivot created by the end of the lift arm pivoting against their stopped position (i.e. rollers 32 in pocket 34*a*), swings pivotally up to lift the far end of pipe carrier 22 from the lower position through an arc vertically upward and horizontally toward the rig structure, as illustrated in FIGS. 1 to 6. Cables 24 may be connected to the underside of pipe carrier 22 a distance D from the carrier's ramp end to permit the carrier to be pulled forward by the cables over upper end 50 of ramp. In the illustrated embodiment, cables 24 are connected to carrier at a point 47*a* that is spaced distance D from the ramp end which is greater than the distance D' that ramp is desired to be pulled past upper end 50 of the ramp. Thus, winch 29 can create a pulling force to raise carrier 22 upwardly from structure 16 and extend the carrier past the ramp over the drill floor.

Figure 12:
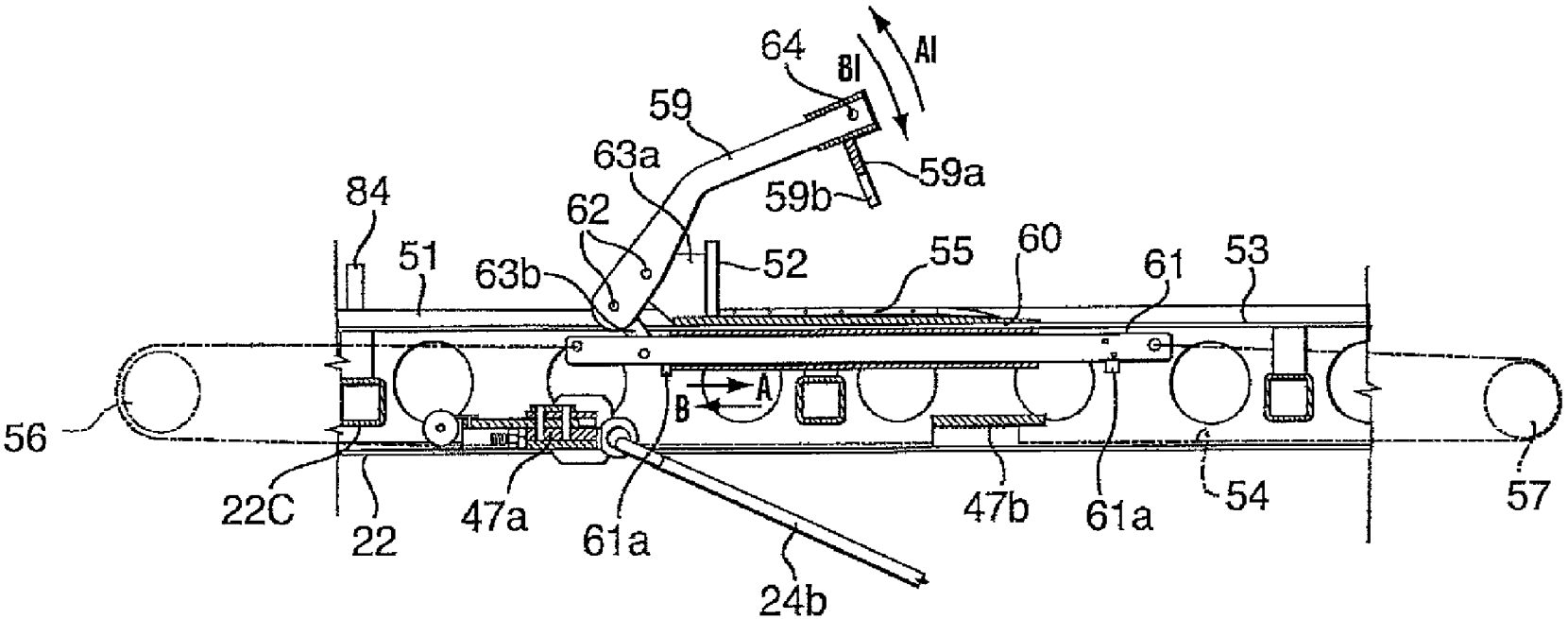
FIG. 12 is a sectional view along line I-I of FIG. 9.

In one embodiment, illustrated in FIG. 12, carrier 22 may include a plurality of connection points 47*a*, 47*b* onto which cables 24 may be connected. Since cable life may be limited by travel about sheaves, cable life may be extendable by changing from one connection point, for example 47*a*, to another connection point, for example point 47*b*, so that two different areas along the cable may be driven over sheaves 25 during periods of the cable operational life.

Carrier 22 includes an upper surface area thereof formed in a configuration so that a pipe joint 20 received therein gravitates to a lowermost, centrally located, cradled position, as illustrated by the various drawings. In particular, the carrier upper surface includes an elongate indentation or trough defined by ramped side surfaces 51, 51'. Carrier 22 carries a pipe stop member 52 that acts to support a pipe joint positioned on the carrier, for example to prevent it from sliding down carrier 22 when it is in the elevated position of FIGS. 3 and 6.

With reference also to FIG. 12, pipe stop member 52 can also be formed to act as a push device to abut against the pipe and push it axially along carrier 22. For example, pipe stop member 52 can be formed to ride along a slot 53 formed between surfaces 51, 51'. In the illustrated embodiment, pipe stop member 52 is driven by an endless cable 54 for movement along the carrier. Pipe stop member 52 includes a slide 55 formed to engage and ride at least along a length of slot 53. Cable 54 connects to slide below the upper surface of the carrier. A sheave 56 and winch 57 drive cable 54 to pull on slide 55, and thereby pipe stop member 52, to move along the carrier. Winch 57 may have a centering V-shaped drum profile to maintain cable 54 in a centered position during operation.

Pipe stop member 52 can, in addition if desired, include a pipe pull feature. In such an embodiment, the pipe stop member can include a pipe engagement device that engages a pipe, when the pipe is positioned in carrier, to move the pipe axially with the stop member. A pipe engagement device can take various forms. It may be useful to form the pipe engagement device to be operable to engage a pipe or release a pipe automatically with operation of the slider, rather than requiring manual operation of the device. In one embodiment shown in FIG. 12, a pipe engagement device includes an arm 59 connected to pipe stop member 52 that can be driven between a position latching over a pipe and a position retracted from engagement with a pipe. The arm is driven between these latching and retracted positions automatically by movement of the pipe stop member. In the illustrated embodiment, pipe stop member 52 is mounted on a sleeve 60 that is engaged, but slidably moveable between stops 61 a on a drive cable attachment member 61. Arm 59 is connected via pivotal connections 62 and a brace arms 63*a*, 63*b* to both sleeve 60 and member 61. Relative movement sleeve 60 and member 61, therefore drives pivotal movement of the arm. As will be appreciated, the weight of a pipe on stop 52 and sleeve 60 to be held in place while member 61 moves first relative to and within sleeve 60 when pulled by cable 54. Stops 61 a limit relative movement of member 61 within the sleeve and will eventually cause movement of member 61 to be transmitted to sleeve 60. When member 61 is moved along direction A relative to sleeve 60, arm 59 will be retracted, arrow A1, and alternately, when member 61 is moved along direction B relative to sleeve 60, arm 59 will be brought around, arrow B1, and, if a pipe is positioned in carrier, latched over the pipe. The configuration of the stop, the sleeve and the arm with the drive system of cable 54 can be arranged so that movement in direction A can cause the pipe stop member 52 to move toward ramp end (in a pushing configuration) and movement in direction B can cause stop member 52 to move along the carrier toward the carrier's far end, which is the direction in which pipe pulling would be most useful. Such an arrangement may be useful where pipes are handled that are of insufficient weight to move easily by gravity along the carrier. Alternately, or in addition, such an arrangement may be useful where it is necessary to move a pipe along the trough to be better positioned, for example, relative to pipe-handling apparatus. Without arm 59 the carrier may have to be elevated to slide the pipe by gravity. In one embodiment, connections 62 may be removable so that arm 59 can be removed from pipe stop member 52 if it is not needed in any particular operation. In the illustrated embodiment, return 59*a* is removably connected by connection 64 that permits the return to be removed from the end of the arm and, if desired, inverted and stored out of an operational position.

Arm 59 can be sized such that return 59*a* is spaced from stop member 52 to engage under the change in diameter at the end of a pipe joint connection. Return 59*a* can include a rounded or angular notch 59*b* to fit over the cylindrical outer surface of a pipe.

Opposed, parallel catwalks 38 and 39, may serve to impart additional structural rigidity into the main structure for adequately supporting the elevated pipe carrier therefrom and provide surfaces over which the pipe joints may be moved to load or dump from carrier 22. Catwalks 38, 39 can be formed in various ways. In some embodiments, only one catwalk may be provided or the catwalks may be eliminated altogether.

Ramp 15 may be hinged to main support structure 16 through, for example, a bearing 45 that elevates the axial centerline of the spaced-apart hinge pins, one of which is seen at 42, an amount to enable the ramp to be folded back onto catwalks 39 and 38 if desired, thereby enabling the entire pipe-handling apparatus to be folded into a compact package for transporting to the next drilling site. Carrier 22 and main support structure 16 may be formed of main beams, for example beams 22*b* and 16*b*, and cross members, for example 22*c*, 16*c*, so that these components can house the drive systems and other subsystems, so that these subsystems may be protected therewithin and the overall pipe-handling apparatus may be substantially self contained. The apparatus may be skid mounted to facilitate transport.

Movement of pipe sections 20 between the pipe rack and the carrier can be quite dangerous and there may be a risk of a pipe actually falling off the carrier, while it is in transition or while it is elevated. Thus, a present pipe-handling apparatus may include any of various components of a pipe control system. In the illustrated embodiments, a pipe control system is shown including a pipe-dumping apparatus, an indexing apparatus, and a lateral stop gate apparatus. A pipe control system may include any or all of these or other features, as desired.

Looking to the details of FIGS. 7 to 11, a pipe-dumping apparatus is shown including kickers 68 and 68' located at spaced-apart locations along pipe carrier 22. Kickers 68, 68' can take various forms and modes of operation. Kickers 68 operate on one side surface 51 of the carrier, while kickers 68' operate on the other 51'. In the illustrated embodiment, each kicker is mounted in a recess 71 and has an upper surface 70 formed to coincide generally with or be recessed below the V-shaped, the upper surface of the carrier indentation formed by surfaces 51, 51'. Upper surface 70 is formed on a body 71 connected to a drive (cannot be seen clearly). The drive may be actuated to move kicker surface 70 to protrude above surface 51, 51' in which it is mounted to thereby abut against a pipe positioned in the indentation. Thus, a pipe in the carrier can be rolled out of the carrier away from the kicker. The kickers on one side, for example all kickers 68, may be operated in unison such that they together act on a pipe while the other kickers, for example 68' remain inactive. When a pipe is being loaded to carrier, the surfaces 70 of all of the kickers remain flush with or recessed below the surfaces 51, 51' to avoid interference with pipe loading. As an example, in one embodiment, the drive includes pivot pins and hydraulic cylinders for the kickers. For example, the kickers are mounted on pivot pins and actuated by a hydraulic cylinder mounted into the beams of the carrier. When the cylinder is retracted, the kicker is pulled upwards and out around its pivot point. When they are deactivated, the kickers are returned flush with ramped surfaces 51, 51' so the stop member 52 can pass smoothly over them. The arrangement of the pivot pin and hydraulic cylinder is not shown in the Figures, but would be well known to a person of ordinary skill in the art based on the teachings herein.

A pipe control system may further include a pipe indexing apparatus, including for example indexers 75, 75' located at spaced-apart locations along cat walks 38, 39. Indexers 75, 75' can take various forms and modes of operation, but act to urge movement of the pipes along the catwalks into or out of the carrier. A pipe indexing apparatus, can therefore replace manual operators such that personnel need not be in this dangerous area. In the illustrated embodiment, indexers 75 operate on one catwalk 38, while indexers 75' operate on the other. In the illustrated embodiment, each indexer has an upper surface 76 formed to be flush with or recessed below its catwalk upper surface. Upper surface 76 is formed on a body 77 connected to a drive mechanism 78 that permits at least one end of each indexer to be raised to protrude above the catwalk surface. A drive mechanism for the indexers can include hydraulic cylinders to drive each end of each indexer, which when activated push an end of the indexer up along guides. An indexer may, therefore, abut against and move a pipe positioned on the catwalk. As will be appreciated, the end of the indexer that is protruded above the catwalk surface will determine in which direction the pipe will roll. Thus, the indexers on one side of the carrier can be selected to operate to either move pipes into or away from the carrier or both, since in most operations the pipes will be moved to and from the pipe racks on both sides of the carrier repeatedly. The indexers on one side, for example all indexers 75, may be operated in unison, as by use of connected plumbing for the hydraulic cylinders, such that they together act to control pipe movement.

Figure 7:
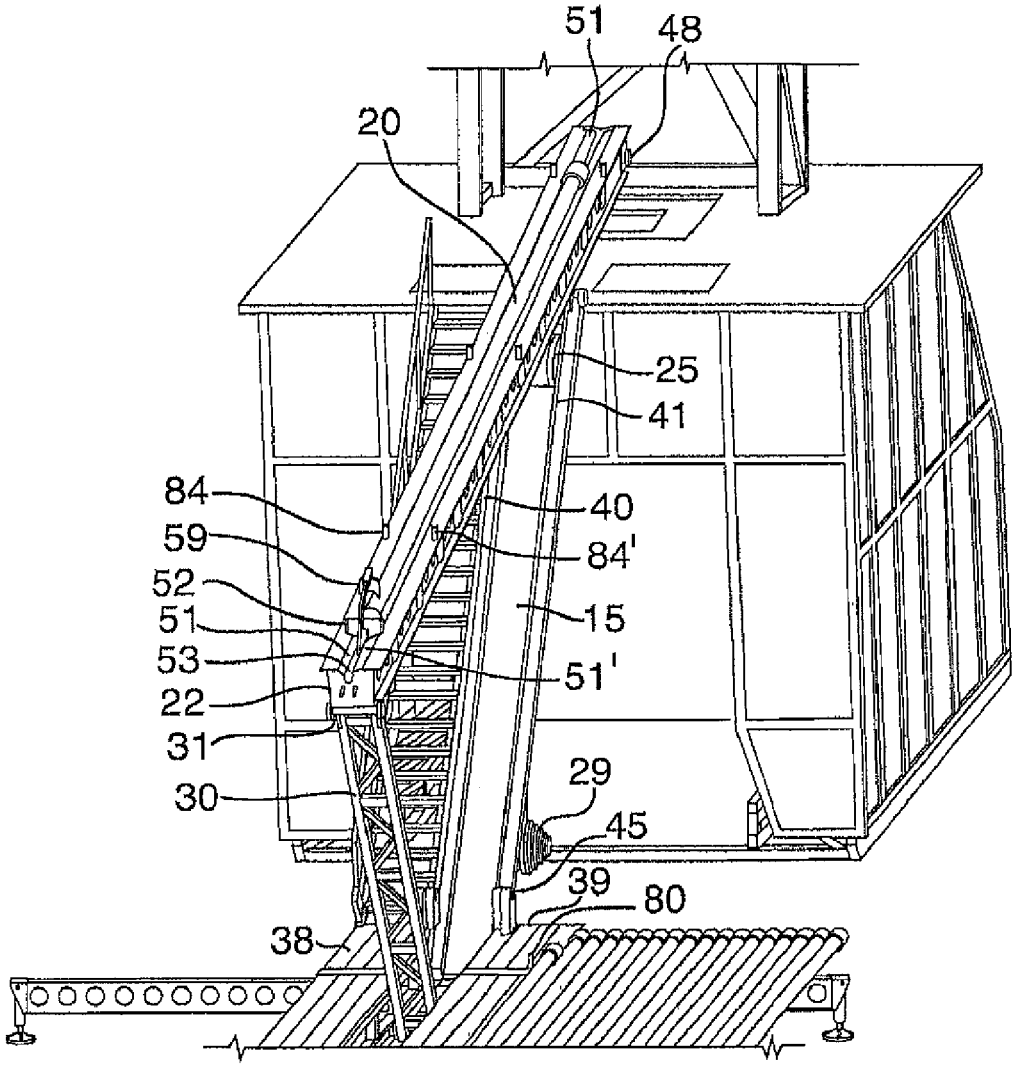
FIG. 7 is an enlarged, perspective view of a carrier useful in a pipe-handling apparatus in a position as shown in FIG. 3.
Figure 8:
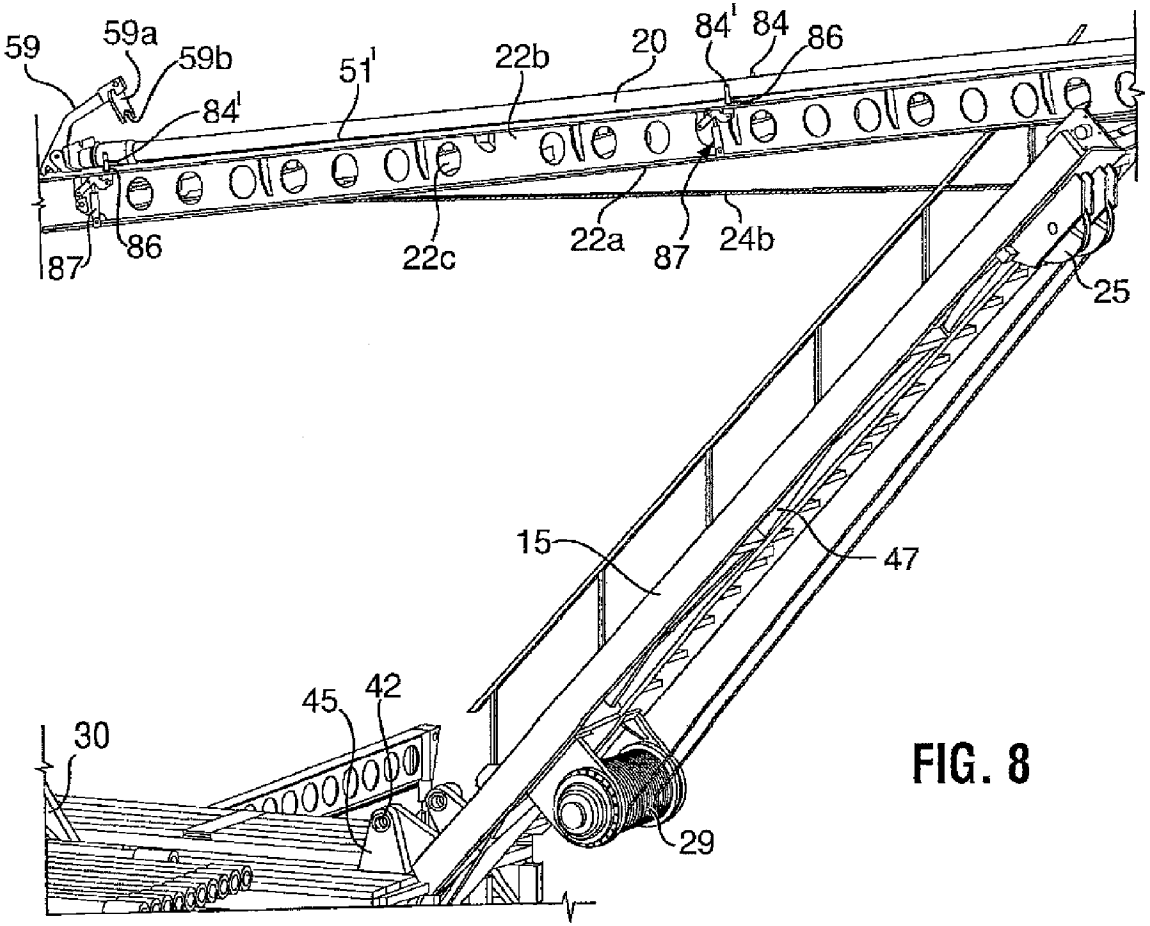
FIG. 8 is another perspective view of the carrier of FIG. 7.

In one embodiment, shown in FIG. 7, the pipe indexing apparatus can include stop pins 80 positioned adjacent a pipe rack carrying the supply of pipe joints. Stop pins 80 can be mountable, possibly releasably mountable, in a position on the catwalk overlapping the operational area traced by indexers, such as indexers 75' in the illustrated embodiment, by approximately one pipe diameter. Pins 80 can be formed to hold back the supply of pipe joints, as by coordinated tilting of pipe rack 11 and selecting the height of pins 80, so that pipe joints on the rack tend to roll against pins 80 and, therefore, be in a position to be acted upon by the indexers. In this pipe indexing apparatus, the drive 78 is selected to permit the upper surfaces of the indexers to be raised a suitable height with respect to pins 80 to lift a pipe, or allow a pipe to roll, over the pins. In one embodiment, the pipes stored on a sloped pipe rack can roll up against pins 80 and indexers 75' can then lift the first most pipe over the pins. The back surface of the outboard end of the indexers can include a tongue 77*a* that extends down and prevents the next adjacent pipe joint from rolling forward under the elevated indexer. When the indexer is retracted, the next available pipe is free to roll up against the pins. Meanwhile the first pipe has rolled down the indexer, across the catwalk and into the carrier trough.

Figure 9:
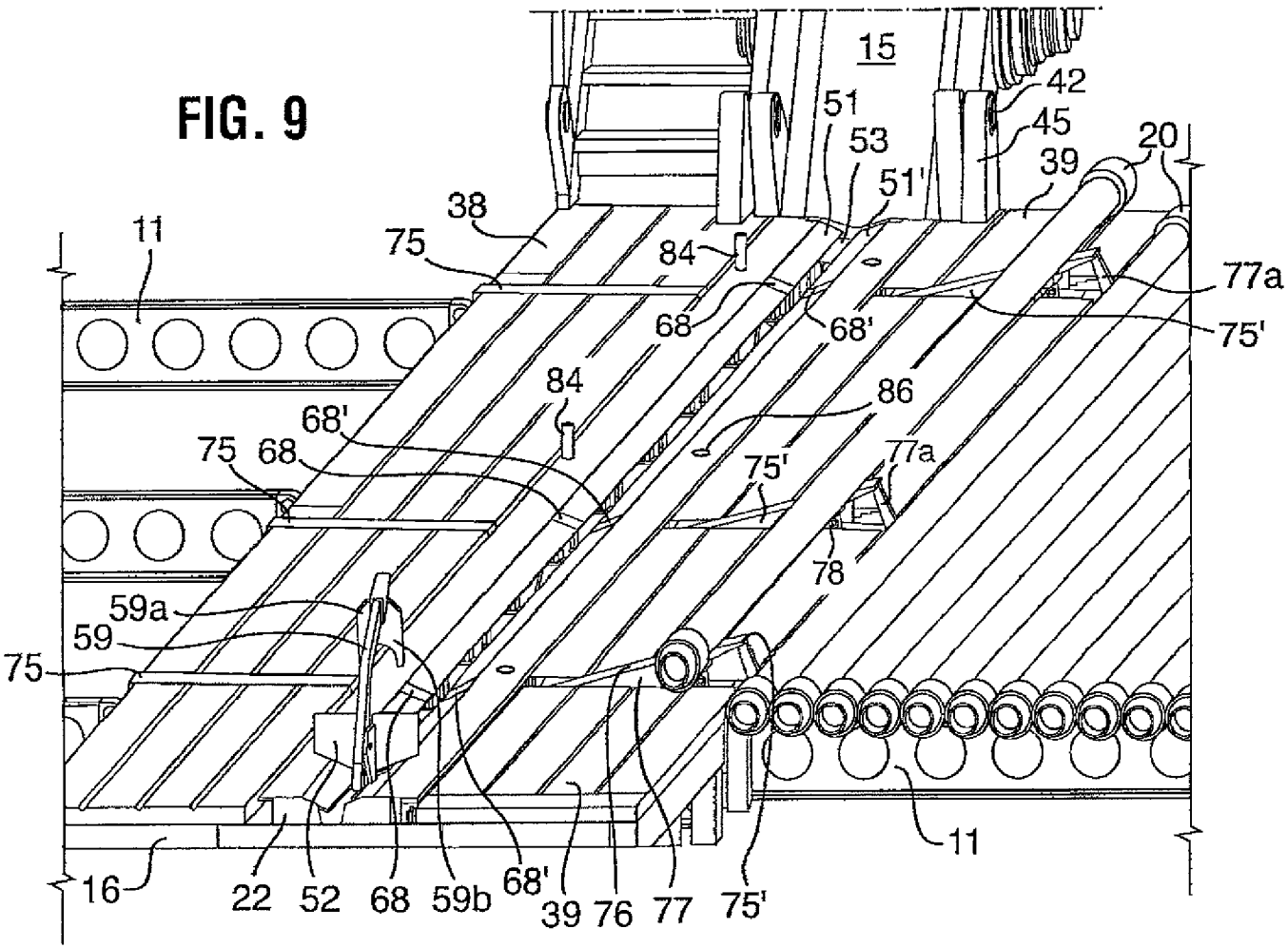
FIG. 9 is an enlarged perspective view of a pipe control system useful in a pipe-handling apparatus.
Figure 10:
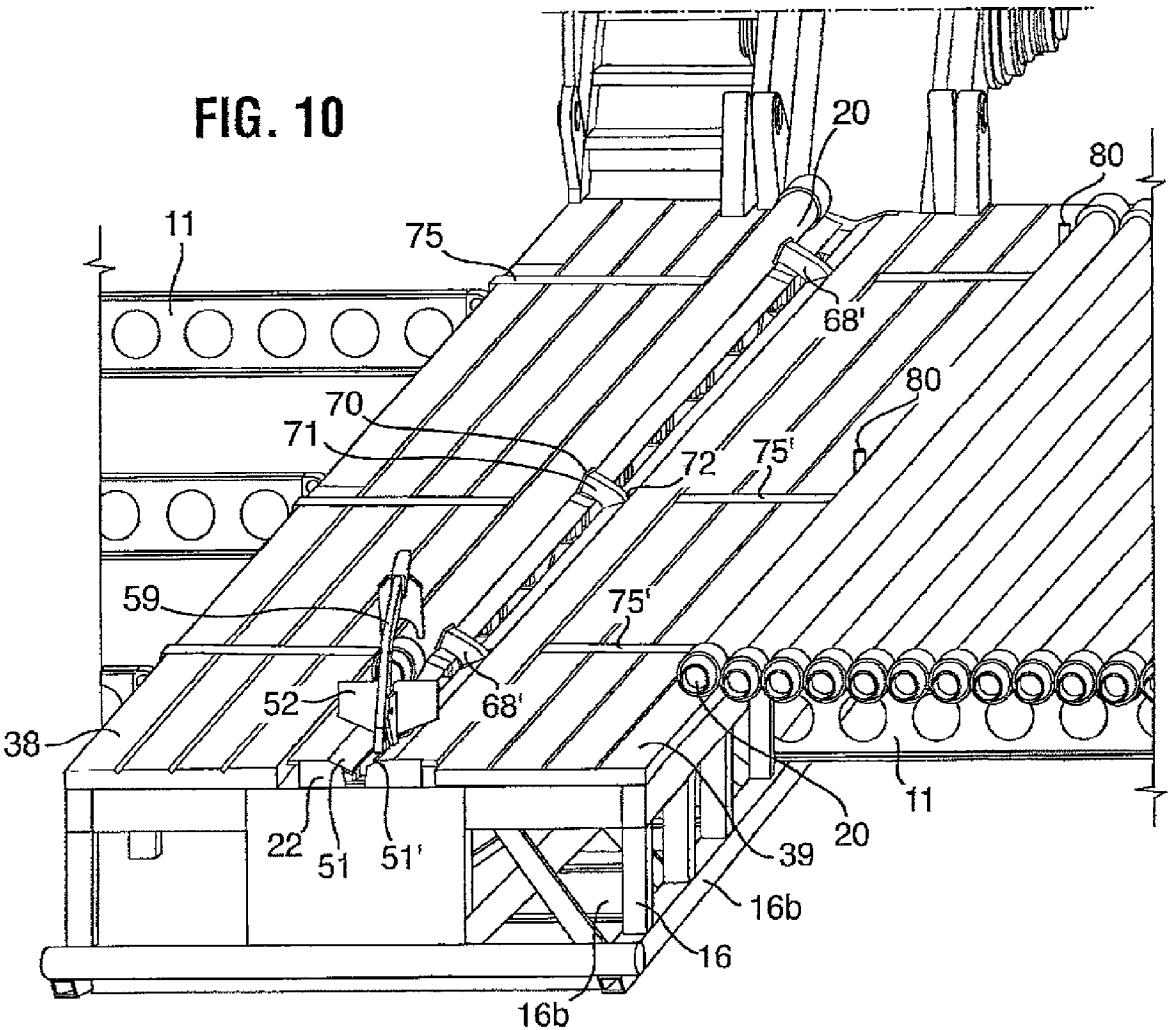
FIG. 10 is another view of the pipe control system of FIG. 9 in another stage of operation.
Figure 11:
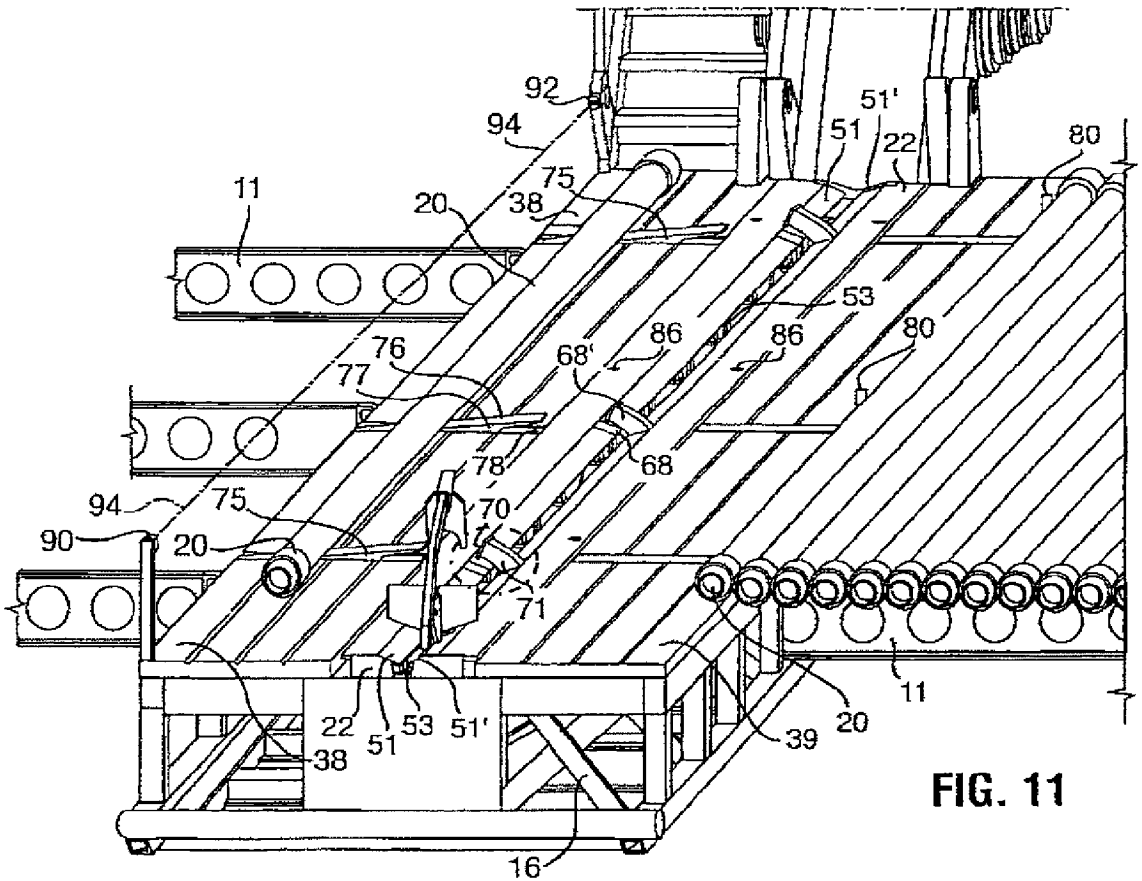
FIG. 11 is another view of a pipe control system of FIG. 9 in another stage of operation.
Figure 11A:
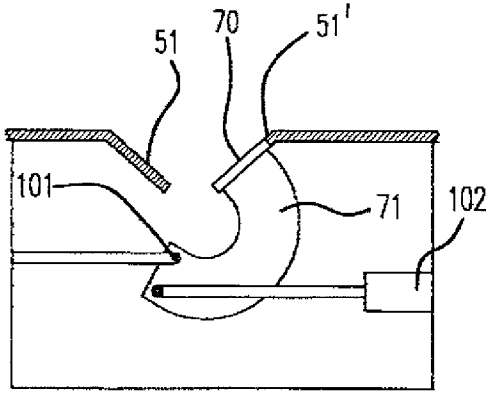
Figure 11B:
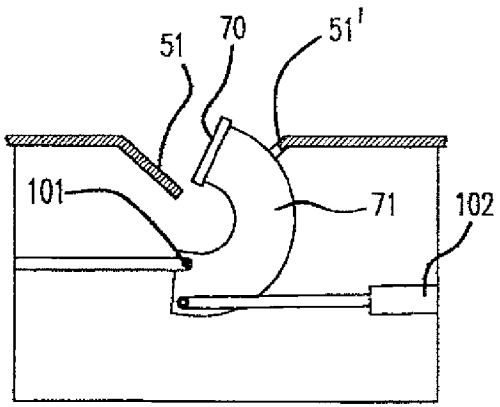

A pipe control system may further include a lateral stop gate apparatus, that acts to prevent accidental lateral movement of a pipe out of the carrier indentation either during movement of the carrier (FIG. 7) or during loading of a pipe (FIG. 9). The lateral stop pin apparatus can take various forms and modes of operation, but includes a structure on the carrier, the structure being moveable between a position protruding above the upper surface of the carrier (to prevent a pipe rolling therepast over the upper surface of the carrier) and a position out of the way of rolling movement of pipes over the surface of the carrier, which may be, for example, recessed in apertures or slots in the upper surface or may be positioned at the side of the carrier. The structure may be, for example, one or more elongate or short walls, a plurality of pins, posts, etc. To act against rolling of an elongate member such as a pipe joint 20, it will be appreciated that the gate structure may be needed at least a plurality of spaced apart position along the carrier. In the illustrated embodiment, the lateral stop gate apparatus includes raisable pins 84, 84' located at spaced-apart locations along pipe carrier on either side of its elongate indentation. Pins 84 operate on one side of carrier 22, while pins 84' operate on the other. In the illustrated embodiment, each pin is positioned in an aperture 86 opening from carrier upper surface and is formed to be moveable by a drive 87 between a position flush with (or recessed below) the carrier upper surface (shown by pins 84 in FIG. 9) and a position protruding above the upper surface of the carrier (shown by pins 84' in FIG. 9). In one embodiment, pins 84, 84' are raised by a hydraulic cylinder with a linkage arrangement providing mechanical advantage. The linkage allows a short stroke, compact cylinder to be used to raise the pins. When the pins are protruding on the upper surface of the carrier, a pipe joint 20 cannot easily roll therepast. As such, the pins can be raised or lowered to control against movement of a pipe. For example, during pipe loading, as shown in FIG. 9, the pins on one side can be lowered to allowed entry of a pipe therepast while the pins 84' on the other side are raised to prevent a pipe from rolling though the indentation and off the carrier. As another example, when moving the carrier or when it is elevated over the drilling floor, as shown in FIG. 7, the pins 84, 84' on both sides of the carrier can be raised to prevent all lateral movement of the pipe off the carrier. Pins 84, 84' can be positioned adjacent sloped surfaces 51, 51' so that any pipe butting against them will tend to fall back into the carrier indentation formed by the sloped surfaces. The pins on one side, for example all pins 84, may be operated in unison such that they together act to control pipe movement.

The pipe-handling apparatus may be controlled for operation of the various components and features thereof. It may be desirable to provide a control system that operates through programmed features to intelligently guide operations. This reduces the need for constant manual supervision and reduces the possibility of operator error. For example with reference to the illustrated embodiments, the controller may be programmed to accept a command such as "load" for loading a pipe to the carrier, wherein the controller ensures that pins 84 are raised, pins 84' are recessed and indexers 75' lift a pipe over pins 80. Additionally or alternately, the controller may operate to control the speed of operations, for example of winch 29, so that the apparatus operates with consideration to efficiency and safety. For example, in response to a command "carrier lift" the winch may be operated to raise the carrier first with a soft start and then quickly to bring the carrier to a position adjacent the upper end of ramp 15, but when the controller determines that the ramp 15 is adjacent the drilling floor, the controller may act to automatically slow the winch to slowly bring the carrier in over the rig floor to a final position. The controller may include a wireless transmitter, such as a hand held panel or joystick transmitter box, for transmitting operator commands. Such a transmitter may include all of the necessary switches and control manipulators to start the motor, and run all functions so that a person controlling the pipe-handling apparatus may be remote from the apparatus, for example on the rig floor or in a rig control booth. A wireless receiver may be used to receive the transmitted signals and relay them to a connected computer. The computer may support software designed to interpret the requests from the transmitter and control all of the functions of the apparatus. For apparatus control, there may also be an operator interface screen to indicate machine status and error conditions. To monitor winch 29 operation, a rotational encoder may be used that tracks rotation of the winch drum and converts that to distance moved by the cable and, thereby, the carrier.

The controller may include feedback safety mechanisms or systems. For example, in one embodiment, main support structure 16 includes a detection beam system in communication with the controller. Detection beam system is selected to monitor the main support structure 16 and feedback to the controller a shutdown signal should the detection beam sense problematic movement on the main support structure, for example movement other than that of pipes rolling and systems normally operating. For example, the detection beam system may include a plurality of emitters 90 and a corresponding plurality of receivers 92 mounted about the structure, for example, over catwalks 38, 39 that generate and monitor a curtain of signals 94, such as light beams. A detection beam system such as this may be used to ensure that the pipe-handling apparatus cannot operate, at least through certain steps, when a person is sensed on the catwalks, as by breaking the curtain of signals 94.

The controller may also record cable operational hours and provide an alert to the apparatus operator when it is desired to move cables from one connection point to another, for example from connection point 47*a* to connection point 47*b*, as previously described, or to replace the cables as required.

In operation, the apparatus is delivered to a drilling site and positioned adjacent a drilling rig. Ramp 15 may be unfolded into an operative position, such as in FIG. 1, set against the rig so that upper end is adjacent the rig floor. The ramp may be allowed to rest freely on the rig substructure drilling floor. In this way, the ramp may float with the rig, as may be useful to accommodate height changes of the rig as may occur during normal rig operations. In one embodiment, safety chains (not shown) may be secured between the ramp and the rig to avoid a problem should support structure 16 get bumped. The pipe-handling apparatus may, if desired, be constructed to best work with the rig, as by selection of the lengths of any of the ramp, the carrier or the lift arm, with consideration as to various parameters such as the nature of pipe to be handled, the height of the rig, etc.

Pipe racks 11 are attached on either side of the main structure 16 so that new pipe to be used can be placed on one side of the apparatus while pipe which comes out of the hole can be placed on the rack on the opposed side of the structure. When the drilling operation commences, drill pipe, or other tubular goods, are rolled from the pipe rack and into the carrier. The racks can be tilted so that the tubulars roll by gravity against pins 80 and are acted upon by pipe indexers 75. The pins 84, 84' of a lateral stop gate apparatus may be operated to control lateral movement of the tubular with respect to carrier 22, during loading and during movement of carrier 22.

A motor and pump energizes winch 29 that pulls the cables 24, thereby elevating the pipe carrier from the position of FIG. 1 into the positions of FIGS. 2 and 3, as described previously. The apparatus for operation may also include a controller, instrumentation or features for operational feedback, power supplies, motor control switchgear, hydraulic power pack with hydraulic reservoir, etc., as will be appreciated.

Carrier 22 moves along ramp 15 with rollers 48 moving along tracks 40, 41. When the carrier reaches the upper open ends of the tracks, the cables continue to pull the carrier up over upper end 50 of the ramp. As such, carrier 22 is extended over floor 12 towards the hole center. During or after the carrier is moved over floor 12, pipe stop member 52 can be actuated to slide the pipe axially along the carrier to enhance access or movement of the pipe. These actions position the end of a tubular in close proximity to the elevators or other rig components. The lengths, heights and configuration of the components of the pipe-handling apparatus can be selected such that the end of the pipe carrier is brought to a position above drilling floor 12 that is convenient for pipe handling. This tubular can then be used by incorporation into the drill string, casing string, etc. Alternately or in addition, arm 59 can be retracted from engagement with the tubular being handled, as by movement of pipe stop member 52.

To move the carrier off the drill floor, the winch 29 can be reversed to generate slack in cables 24. Winch 29 is caused to play out the cable in a controlled manner allowing gravity to retract the carrier and lift arm back into their retracted, lower position. If further tubulars are required to be moved from the racks 11 to the drill floor, another pipe joint can be loaded and elevated to the drill floor. The winch 29 can be of a high speed rating so that the pipe can be brought to the drill floor rapidly to correspond with preferred tripping operations. In one embodiment, the time to lift or retract may be around 10 to 60 seconds. To keep up with a tripping and laying down process, the time to lift or retract may be less than 30 seconds and generally less than 20 seconds.

When the time comes to remove a pipe string from the hole, the string may be broken out by disconnecting the tubular joints and placing an end thereof on the pipe carrier 22 until an advancing end thereof abuts against pipe stop member 52. As the pipe is lowered onto the carrier or prior thereto, pipe stop member 52 can be reversed along the carrier to a position just behind that where the pipe would stop when being lowered onto the carrier by the blocks and elevator in the derrick. The ramped surfaces of the trough act to guide the pipe along the carrier and pins 84, 84' may be elevated as a safety precaution. Just prior to releasing the elevators the pipe stop is moved forward to support the end of the pipe so that it doesn't slide back uncontrolled. Once the elevators are removed, the pipe is controllably allowed to slide back or is pulled back by the pipe stop member 52 so that the entire pipe is on the carrier. Arm 59 can be operated to engage a pipe introduced onto carrier 22 and pull it back. If arm 59 is connected to pipe stop member 52 in an operative manner, it may be oriented to engage over or retract from a pipe on the carrier, depending on the operation to be completed. This may be achieved by driving cable 54.

Thereafter, pipe carrier 22 is retracted into recess 35 of main structure 16 whereupon pins 84, 84' are lowered and the automatic pipe dumping apparatus, including either kickers 68 or kickers 68', causes the joint of pipe to move out of the elongated indentation of the carrier. Indexers 75 or 75' may be actuated to move the pipe across the catwalks onto either of pipe racks 11, as desired. Pipe stop 52 and/or arm 59 can be operated to reposition a pipe at any time.

When it is time to relocate the pipe-handling apparatus, ramp 15 may be folded about hinge pin 42 and the entire apparatus may be transported to the next drill site where it is again erected in the manner described above. During transport of the apparatus, the pipe racks may be folded 90.degree. adjacent the main support structure. The racks may be supported on integral shipping hooks integrated into the side of the main support structure.

The previous description of the disclosed embodiments is provided to enable any person of ordinary skill in the art to make or use the present invention. Various modifications to those embodiments will be readily apparent to those of ordinary skill in the art, and the generic principles defined herein may be applied to other embodiments without departing from the spirit or scope of the invention. Thus, the present invention is not intended to be limited to the embodiments shown herein. For example, although various features of the invention including for example, various carrier movement mechanisms, various pipe stop arrangements and various components of pipe control systems including, for example, a pipe feed indexing apparatus and a lateral stop gate apparatus, it is to be understood that any or all of these features alone or in combination may be installed to a pipe-handling apparatus and such protection is or may be sought. Furthermore, the protection is to be afforded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for."

What is claimed is:

1. A pipe-handling apparatus for moving a pipe to and from a drilling floor of a drilling rig, the pipe-handling apparatus comprising:

a main support structure, a ramp extendable between the main support structure and the drilling floor, the ramp including an upper end, a pipe carrier mounted on the main support structure for moving relative thereto between a lower position and an elevated position over the ramp, the carrier including a ramp end adjacent the ramp, a far end, a lower portion and an upper surface, a cable drive system for pulling the carrier from the lower position to the elevated position while the lift arm is pulled lengthwise along the track until it is stopped against a pocket in the track, the cable drive system including a cable connected to the lower portion of the pipe carrier a distance from the ramp end such that the carrier is pulled by the cable so the pipe carrier ramp end extends beyond and is supported by the upper end of the ramp when the pipe carrier is in the elevated position, wherein the pocket defines a depression in the track whereby a roller associated with the arm causes the lift arm to pivot up thereby lifting the carrier when the roller abuts an inside portion of the depression.

2. The pipe-handling apparatus of claim 1 wherein the carrier includes rollers mounted adjacent the ramp end, the cable secured to the carrier between the rollers and the far end.

3. The pipe-handling apparatus of claim 2 wherein the rollers exit the upper end of the ramp to move the carrier into the elevated position.

4. The pipe-handling apparatus of claim 1 wherein the cable drive system pulls the carrier to the upper end of the ramp and, when the carrier reaches the upper end of the ramp, the cable configured to continue applying a pulling force on the ramp to drive the lower portion to slide along and protrude beyond the upper end of the ramp.

5. The pipe-handling apparatus of claim 1 wherein the ramp upper end includes a bearing surface on which the carrier is supported when in the elevated position.

6. The pipe-handling apparatus of claim 1 wherein the cable is roved about upper sheaves mounted near the upper end of the ramp.

7. A pipe-handling apparatus for moving a pipe to and from a drilling floor of a drilling rig, the pipe-handling apparatus comprising:

a main support structure;

a fixed-length, unitary pipe carrier mounted on the main support structure adapted to move relative thereto between a lower position and an elevated position selectable to be accessible from the floor of the drilling rig, the carrier being elongate including a first end, a far end opposite the first end, an upper surface, an elongate indentation on the upper surface extending from the first end to a position adjacent the far end, the elongate indentation formed to accommodate a pipe therein and a plurality of lateral gate structures spaced apart and positioned alongside the elongate indentation; and a drive system adapted to move the pipe carrier from the lower position to the elevated position, wherein the pipe carrier has a plurality of actuatable lateral gate structures and a plurality of corresponding apertures in the upper surface thereof through which the gate structures can protrude such that accidental lateral movement of the pipe out of the pipe carrier is prevented when the pipe is disposed therein.

8. The pipe-handling apparatus of claim 7 wherein the elongate indention includes a length and a width shorter than the length, and the plurality of lateral gate structures are positioned along the length of the elongate indentation.

9. The pipe-handling apparatus of claim 7 further comprising a pipe-stop member in the elongate indentation positioned relatively closer to the far end than to the first end and the plurality of lateral gate structures spaced apart between the pipe stop member and the first end.

10. The pipe-handling apparatus of claim 9 wherein the pipe stop member comprises a pipe engagement device that engages a pipe when the pipe is positioned in the carrier to move the pipe axially with the stop member.

11. A method for operating an oilfield pipe-handling apparatus to move a pipe between a pipe rack and a drilling rig floor, the method comprising:

providing a pipe carrier moveable between a lower position adjacent a pipe rack and an upper position adjacent a drilling rig floor, the pipe carrier including an upper surface configured to support and guide a pipe thereon;

positioning the pipe carrier in its lower position adjacent the pipe rack;

raising a lateral stop gate on at least a first side of the pipe carrier so as to protrude up from the upper surface, wherein the protruding lateral stop gate prevents accidental lateral movement of the pipe out of the carrier;

rolling a pipe from the pipe rack onto the pipe carrier upper surface toward the lateral stop gate; and moving the pipe carrier toward the upper position when the pipe is supported on the upper surface of the pipe carrier to facilitate access to the pipe from the drilling rig floor.

12. The method of claim 11 wherein during rolling the pipe, the pipe rolls over a second side of the pipe carrier opposite the first side of the carrier, and before moving the pipe carrier a second lateral stop gate is raised on the second side of the pipe carrier such that the second lateral stop gate protrudes up from the upper surface.

13. The method of claim 11 wherein during rolling a pipe onto the pipe carrier, the pipe is stopped by abutment against the lateral stop gate and comes to rest on the pipe carrier.

14. The method of claim 11 wherein moving the pipe carrier is controlled by a control system that automatically ensures that a lateral stop gate is protruding above the upper surface of the pipe carrier on either side of the pipe before moving the pipe carrier.

15. A pipe-handling apparatus adapted to move a pipe to and from a drill floor of a drilling rig, the pipe-handling apparatus comprising:

a main support structure;

a ramp extendable between the main support structure and the drilling floor;

a fixed-length, unitary pipe carrier mounted on the main support structure adapted to move relative thereto between a lower position and an elevated position over the ramp, the carrier including a ramp end adjacent the ramp, a far end, and an elongate indentation on its upper surface to accommodate a pipe therein;

a pipe supply rack adjacent the main support structure;

a pipe-feeding mechanism adapted to position and load a pipe one at a time from the pipe supply rack onto the pipe carrier in the lower position;

a lift arm including a first end and a second end, the lift arm being pivotally connected at its first end adjacent the far end of the carrier and operable below the carrier to lift and support the carrier's far end to an elevated position;

a track on the main support structure adapted to support axial sliding motion of the carrier and the lift arm therealong, the track including a pocket that defines a depression in the track to limit axial movement of the second end of the lift arm along the track toward the ramp when a friction-reducing member associated with the arm abuts an inside portion of the depression; and a drive system adapted to pull the carrier from the lower position to ride along the ramp to the elevated position, the drive system capable of pulling the lift arm lengthwise along the track until it is stopped against the stop in pocket in the track and to continue pulling to cause the lift arm to be pivoted up about the pocket to lift the far end of the carrier.

16. The pipe-handling apparatus of claim 15 further comprising an indexing arm operably associated with the pipe supply rack that is configured to separate a single pipe from a plurality of pipes and to move the single pipe from the pipe supply rack to the elongate indentation.

17. The pipe-handling apparatus of claim 15 wherein the pipe-feeding mechanism causes rolling movement of a pipe to position and load the pipe.

18. The pipe-handling apparatus of claim 15 wherein the pipe-feeding mechanism includes a pipe supply stop adapted to position a first pipe to be picked up and an indexing device to move the first pipe past the pipe supply stop towards the pipe carrier.

19. A pipe-handling apparatus for moving a pipe to and from a drilling floor of a drilling rig, the pipe-handling apparatus comprising:

a main support structure, a ramp extendable between the main support structure and the drilling floor, a fixed-length, unitary pipe carrier mounted on the main support structure adapted to move relative thereto between a lower position and an elevated position over the ramp, the pipe carrier including a ramp end adjacent the ramp, a far end, and an elongate indentation on its upper surface to accommodate a pipe therein, a lift aim including a first end and a second end, the lift arm being pivotally connected at its first end adjacent the far end of the pipe carrier and operable below the pipe carrier to lift and support the pipe carrier's far end to an elevated position, a track on the main support structure adapted to support axial sliding motion of the pipe carrier and the lift arm therealong, the track including a stop adapted to limit axial movement of the second end of the lift arm along the track toward the ramp, and a drive system for pulling the pipe carrier from the lower position to ride along the ramp towards the elevated position, the drive system including a winch and a cable connected between the pipe carrier and the winch, wherein the winch and cable are collectively configured to pull the lift arm lengthwise along the track until the lift arm is stopped against a pocket in the track that defines a depression in the track, to continue pulling to cause the lift arm to be pivoted up about the pocket to lift the far end of the pipe carrier when a friction-reducing member associated with the arm abuts an inside portion of the depression, and to continue pulling to cause the pipe carrier's ramp end to move past an upper end of the ramp such that the pipe carrier is moved into the elevation position extending past and above the upper end of the ramp, wherein the cable is roved to pull the pipe carrier up along the ramp and wherein the cable is connected to the underside of the pipe carrier a distance from the pipe carrier's ramp end to permit the pipe carrier to be pulled forward by the cable over the upper end of ramp.

20. The pipe-handling apparatus of claim 19 wherein the cable is connected to the pipe carrier at a point spaced a distance from the ramp end greater than a desired distance that the pipe carrier is desired to be pulled past the upper end of the ramp.

21. The pipe-handling apparatus of claim 19 further comprising a plurality of connection points on the pipe carrier through which the cable is adapted to be selectably connected.

22. The pipe-handling apparatus of claim 19 wherein the pipe carrier includes one or more friction-reducing members to facilitate riding along the track.

23. The pipe-handling apparatus of claim 19 wherein the pipe carrier and the drive system are adapted to have the pipe carrier ride up and extend past the end of the ramp over the drilling floor.

24. The pipe-handling apparatus of claim 19 wherein the ramp includes a bearing surface on its upper end adapted to support movement of the pipe carrier thereover.

25. The pipe-handling apparatus of claim 19 wherein the pocket is formed to capture the second end of the lift arm and the friction-reducing member comprises at least one roller.

26. The pipe-handling apparatus of claim 25 wherein a pipe stop member is configured for axial movement along the pipe carrier.

27. The pipe-handling apparatus of claim 26 further comprising a slot formed in the elongated indentation and wherein the pipe stop member is mounted through the slot and connected to an endless cable to facilitate movement along the entire length of the pipe carrier.

28. The pipe-handling apparatus of claim 19 further comprising a lateral stop gate on the pipe carrier.

29. The pipe-handling apparatus of claim 28 wherein the lateral stop gate includes a plurality of raisable pins carried with the pipe carrier and positioned along each side of the pipe carrier.

* * * * *